US009121113B2

(12) United States Patent
Romine

(10) Patent No.: US 9,121,113 B2
(45) Date of Patent: Sep. 1, 2015

(54) WOOL, FLEECE AND/OR FIBER PICKER APPARATUS AND METHODS

(71) Applicant: Paige Romine, Somerset, CA (US)

(72) Inventor: Paige Romine, Somerset, CA (US)

( * ) Notice: Subject to any disclaimer, the term of this patent is extended or adjusted under 35 U.S.C. 154(b) by 188 days.

(21) Appl. No.: 13/875,250

(22) Filed: May 1, 2013

(65) Prior Publication Data

US 2013/0291339 A1 Nov. 7, 2013

Related U.S. Application Data

(60) Provisional application No. 61/641,278, filed on May 1, 2012.

(51) Int. Cl.
*D01G 7/12* (2006.01)

(52) U.S. Cl.
CPC ..... *D01G 7/12* (2013.01)

(58) Field of Classification Search
CPC ..... D01G 7/06; D01G 7/12; D01G 9/06; D01G 9/14
USPC ..... 19/2, 81
See application file for complete search history.

(56) References Cited

U.S. PATENT DOCUMENTS

| | | | | | |
|---|---|---|---|---|---|
| 1,483,495 | A | * | 2/1924 | Vishloff | 19/115 R |
| 1,571,937 | A | * | 2/1926 | Frye | 119/632 |
| 1,695,765 | A | * | 12/1928 | Howes | 19/98 |
| 1,792,831 | A | * | 2/1931 | Gourdeau | 19/98 |
| 1,818,495 | A | * | 8/1931 | Midgley | 119/632 |
| 1,820,380 | A | * | 8/1931 | Dutton | 19/98 |
| 1,889,369 | A | * | 11/1932 | Midgley | 19/98 |
| 2,054,280 | A | * | 9/1936 | Brown | 19/81 |
| 3,166,797 | A | * | 1/1965 | Mayer, Jr. | 19/81 |
| 4,107,821 | A | * | 8/1978 | Herubel | 19/127 |
| D616,651 | S | * | 6/2010 | Lin | D4/132 |

* cited by examiner

*Primary Examiner* — Shaun R Hurley
(74) *Attorney, Agent, or Firm* — Earle Jennings

(57) ABSTRACT

A picking device is adapted for a user to operate to pick apart a fiber to create a picked apart fiber that is ready for carding in a home. The picking device is adapted to perform: protect the user from bodily injury during operation of the picking device, protect possibly other people from injury when the picking device is not in operation, protect a furniture surface upon which the picking device is laid upon, and/or remove the picked apart fiber while protecting the user's hands and/or fingers. Components of the picking device are disclosed. Methods and apparatus adapted to manufacture the components of the picking device are disclosed.

7 Claims, 7 Drawing Sheets

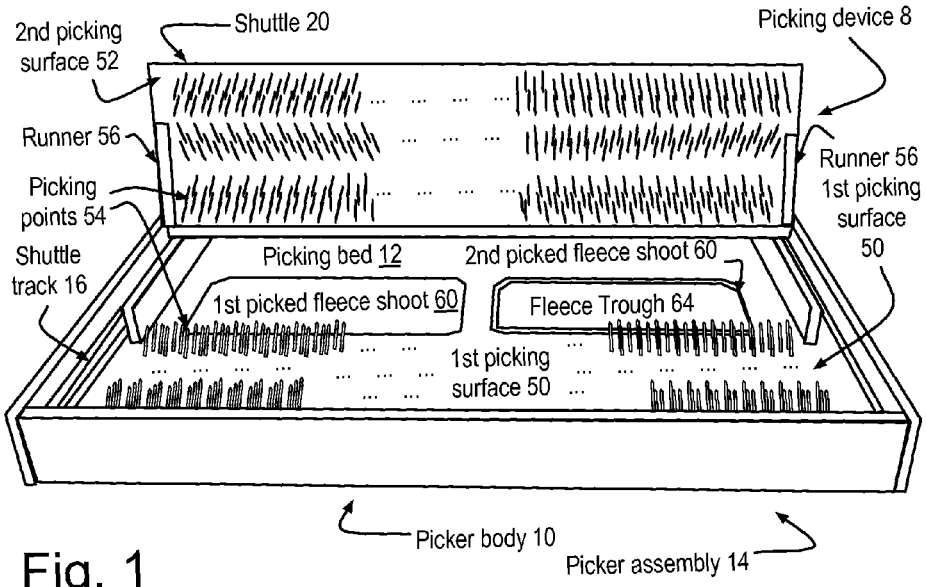
Fig. 1
Fig. 2
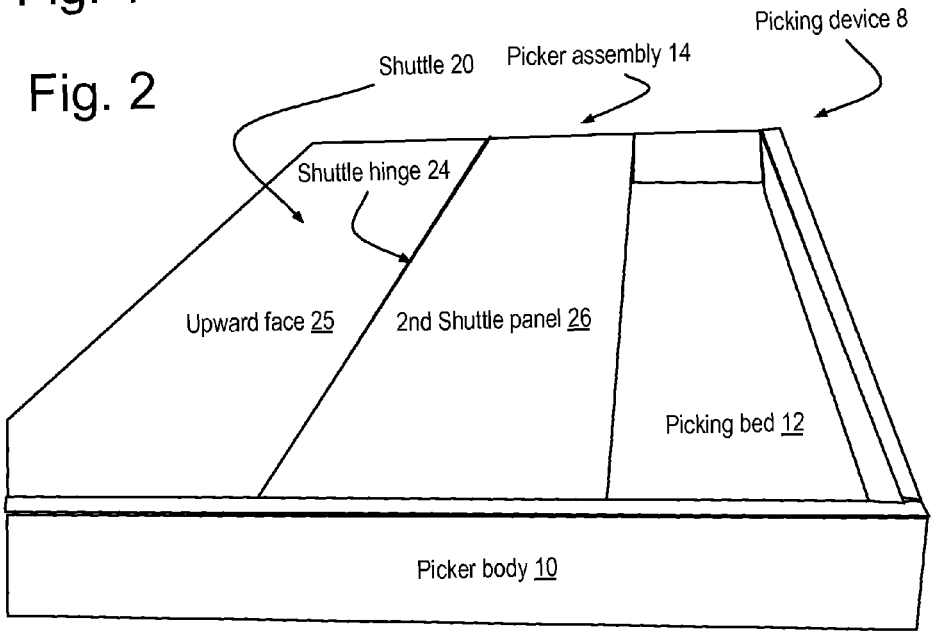

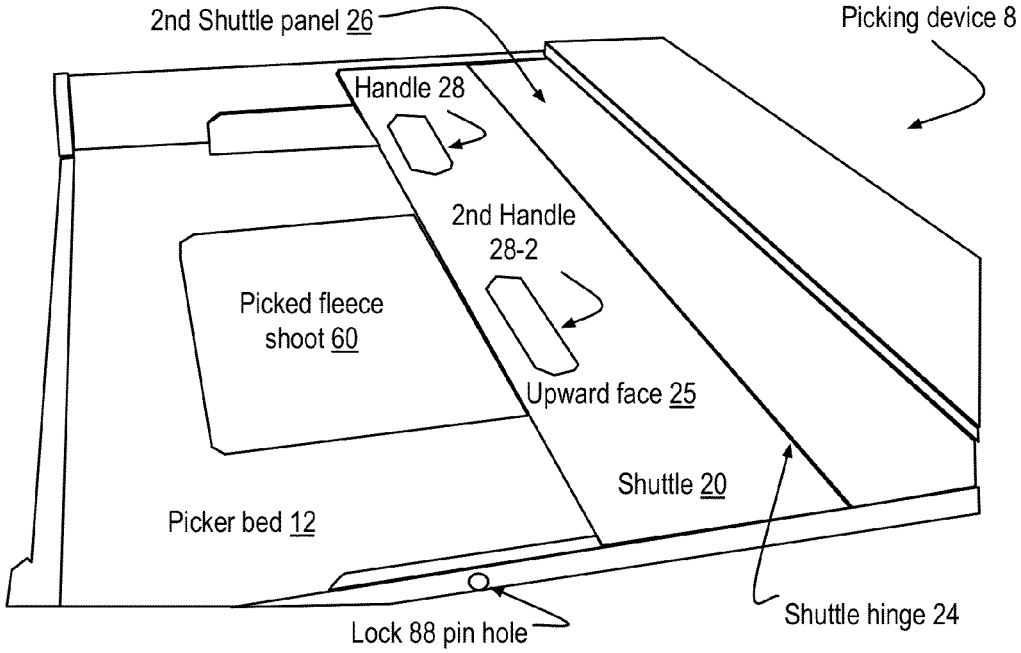
Fig. 3
Fig. 4
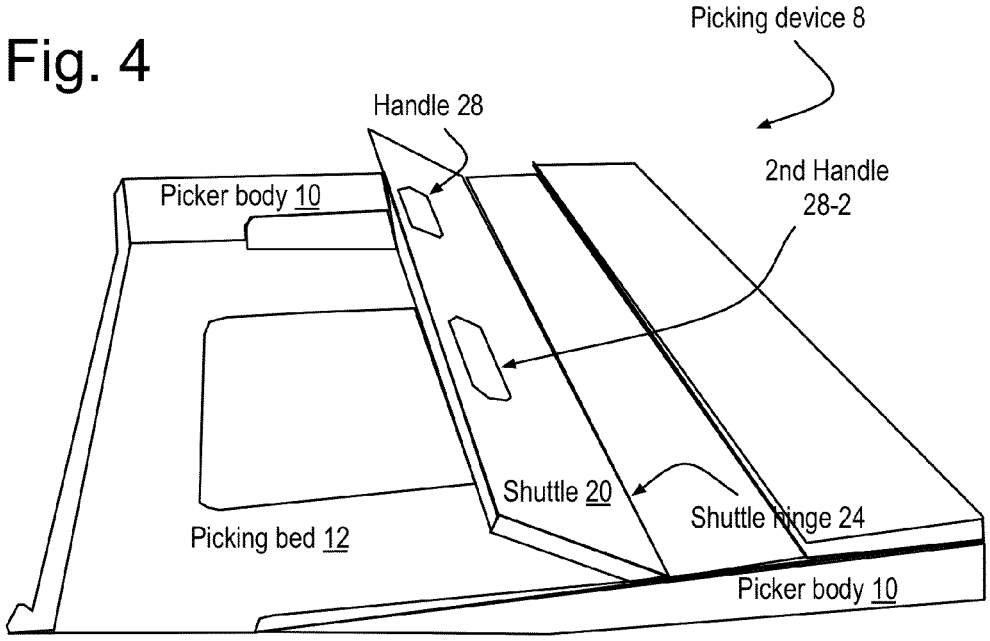

Fig. 5
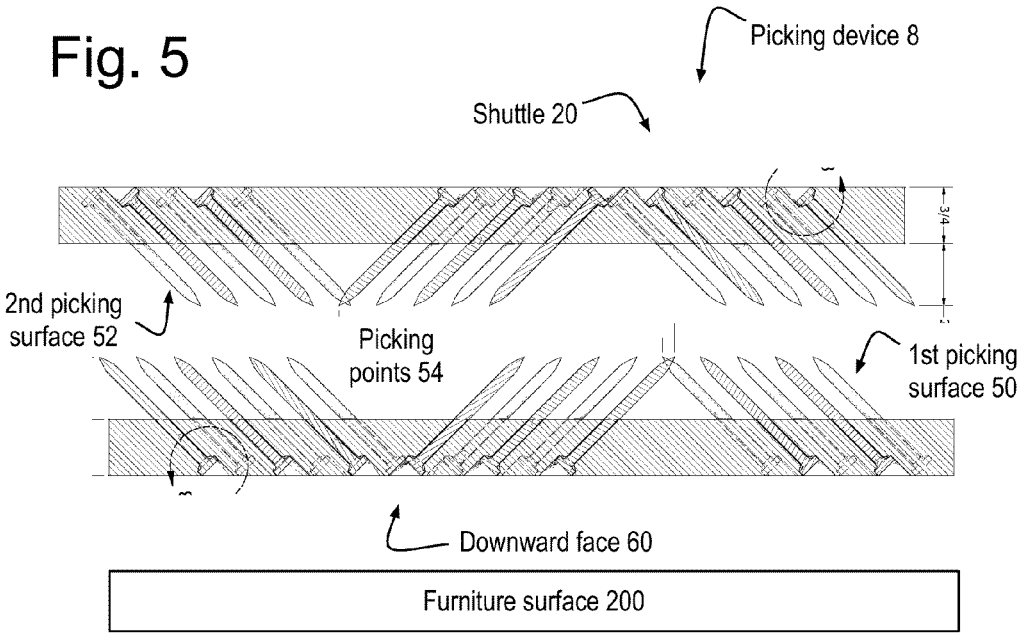
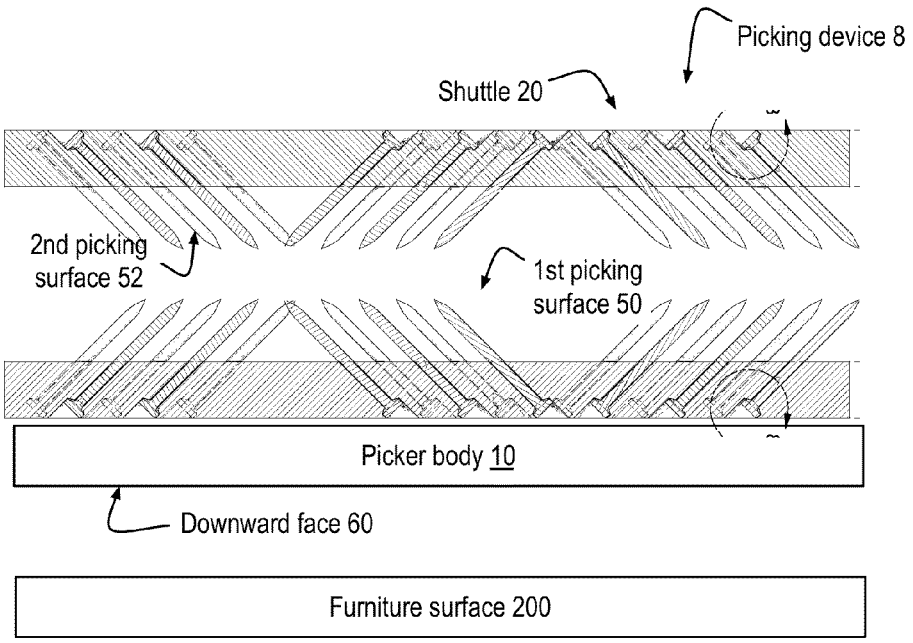
Fig. 6

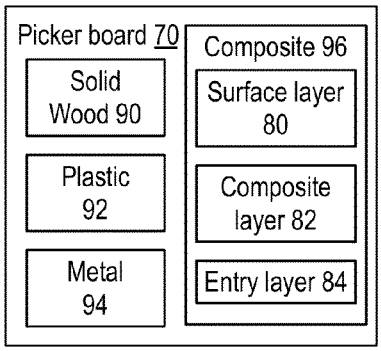
Fig. 11B
Fig. 13
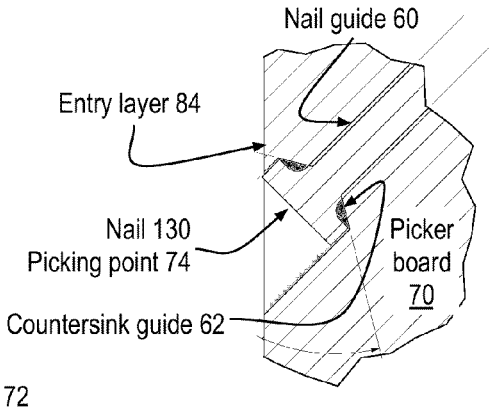
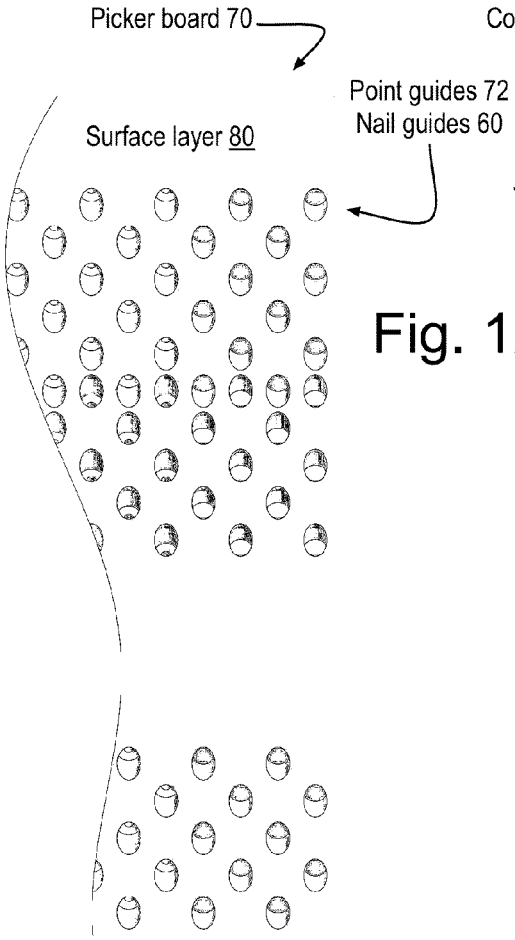
Fig. 12
Fig. 14
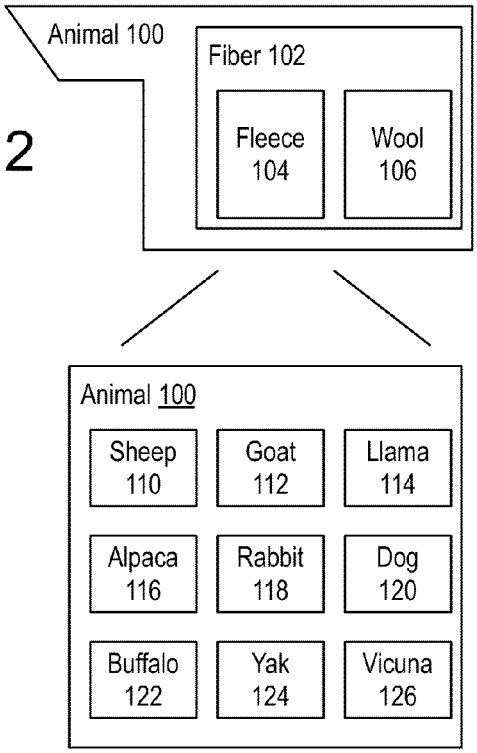

WOOL, FLEECE AND/OR FIBER PICKER APPARATUS AND METHODS

CROSS REFERENCE TO RELATED APPLICATIONS

This application claims priority to Provisional Patent Application No. 61/641,278 filed 1 May 2012, entitled "Wool and Picking device Apparatus and Methods".

TECHNICAL FIELD

This invention relates to a picking device adapted for a user to operate to pick apart a fiber to create a picked apart fiber that are ready for carding in a home. The fiber may include fleece and/or wool from an animal. The picking device is adapted to perform at least one of the following: protect the user from bodily injury during operation of the picking device, protect possibly other people from injury when the picking device is not in operation, protect a furniture surface upon which the picking device is laid upon, and/or remove the picked apart fiber while protecting the user's hands and/or fingers.

BACKGROUND OF THE INVENTION

In North America, there is a significant cottage industry based around the preparation of fleeces for hand spinning. Animals are shorn in the spring to create fleeces. The fleeces are often washed. A picking device will pick apart the (possibly washed) fleece to prepare it for a carding machine. The carding machine creates roves of wool that are aligned to make hand spinning easier. The spun wools and fleeces are then used in a variety of textile arts such as weaving, knitting, crochet, felting and macramé.

Why pick apart the fleece? Most wool bearing animals spend most, if not all, of their time outdoors in pastures or pens. Their coats become deeply impregnated with dirt, sticks, brambles, straw and other debris. Washing the shorn coats removes some of the dirt, but the hair or wool tends to become even more clumped up. Picking it apart is extremely useful because until that is done, it is often very difficult and/or impossible to run the fleece through a carding machine, which is the next step.

SUMMARY OF THE INVENTION

Technical Problems to Be Solved

There are a couple of fleece picking devices on the market. While these machines do pick apart fleeces, they have several problems:

- Both machines have open beds of sharp nails that can, and in some cases have, caused bodily injury to their users or children.
  - One of the machines literally tore a woman's breast while she was using it.
  - The other machine cannot be locked to prevent children from sticking their hands between two surfaces literally bristling with nails and constructed to pick apart whatever is put between them.
- At least one of the machines has a bottom surface including the canted nail heads of dozens to hundreds of nails jutting out, so that it scratches up furniture upon which it may be set.

- Removing the picked fleece material from these machines is done with one's hands and fingers, which can be scratched or poked by one or more of the (often very sharp) nails.

How the Technical Problems Are Solved by Various Embodiments of the Invention This application discloses a picking device 8 adapted for a user to operate to pick apart a fiber to create a picked apart fiber 90 that is ready for carding in a home. The fiber may include fleece and/or wool from an animal. The picking device 8 is adapted to perform at least one of the following:

- protect the user from bodily injury during operation of the picking device 8,
- protect possibly other people from injury when the picking device 8 is not in operation,
- protect a furniture surface 200 upon which the picking device 8 is laid, and/or
- remove the picked apart fiber 90 while protecting the user's hands and/or fingers.

The invention also includes innovative methods of operation and manufacture, which will be further discussed in the detail descriptions which follow.

BRIEF DESCRIPTION OF THE DRAWINGS

FIG. 1 and FIG. 2 show a first example of a picking device 8 adapted for a user to operate and pick apart a fiber to create a picked apart fiber 90.

FIG. 3 and FIG. 4 show a second example of the picking device 8.

FIG. 5 and FIG. 6 shows some details of either example of the picking device 8, where the first set and the second set of cross-angled nails are adapted so that the nails of the second set pass between the nails of the first set as the engaged downward picking surface 52 moves back and forth through the nails of the upward picking surface 50.

FIG. 11A and FIG. 11B show some details of the picking surface 50 and/or the picking surface 52, in particular, the picking board 70 as shown in FIG. 10.

FIG. 12 shows the picker board 70 by itself as seen from the surface layer shown in FIG. 11A and FIG. 11B.

FIG. 13 shows some details of the picking point 74 as a nail 130 residing below the entry layer 84 in with the head of the nail lodged a countersink guide 62 and the shank of the nail passing through a nail guide.

FIG. 14 shows an animal 100 producing fiber 102, which typically includes fleece 104 and/or wool 106. The animal may be genetically derived from at least one, and sometimes more than one of the following: a sheep 110, a goat 112, a llama 114, an alpaca 116, a rabbit 118, a dog 120, a buffalo 122, a yak 124 and/or a vicuna 126.

DETAILED DESCRIPTION OF THE DRAWINGS

Figure 7:
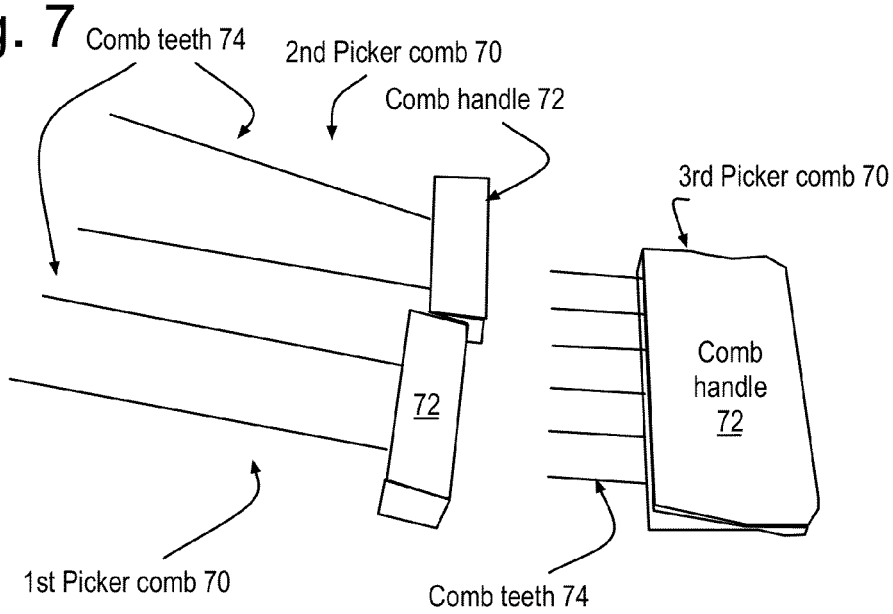
FIG. 7 shows some examples of picker combs 70.

This application discloses a picking device 8 adapted for a user to operate to pick apart a fiber to create a picked apart fiber 90 that is ready for carding in a home. The fiber may include fleece and/or wool from an animal. The picking device 8 is adapted to perform at least one of the following:

- protect the user from bodily injury during operation of the picking device 8,
- protect possibly other people from injury when the picking device 8 is not in operation,
- protect a furniture surface 200 upon which the picking device 8 is laid upon, and/or
- remove the picked apart fiber 90 while protecting the user's hands and/or fingers.

FIG. 1 and FIG. 2 show a first example of the picking device 8 adapted for a user to operate and pick apart a fiber to create a picked apart fiber 90. The picking device 8 may include the picker assembly 14 combined with the shuttle 20 to support the back-and-forth movement of the shuttle 20 over the picking bed 12 to process part or all of a fiber 102 between the shuttle 20 and the bed to create a picked apart fiber 90 ready for carding. The fiber 102 is shown on an animal 100 in FIG. 14 before the animal is shorn. Often, the fiber includes a fleece 104 and/or a wool 106.

The picker body 10 may be adapted to couple to the picking bed 12 during normal operation. It also frequently provides one or more tracks 16 in which the shuttle 20 can be oscillated or moved back and forth to engage with the picking bed 12 in the presence of the fiber 102 to create the picked apart fiber 90 shown in FIG. 8.

The picking bed 12 includes an upward picking surface 50, also referred to as the first picking surface 50, a downward face 90 and at least one picked fleece shoot 60.

Figure 9:
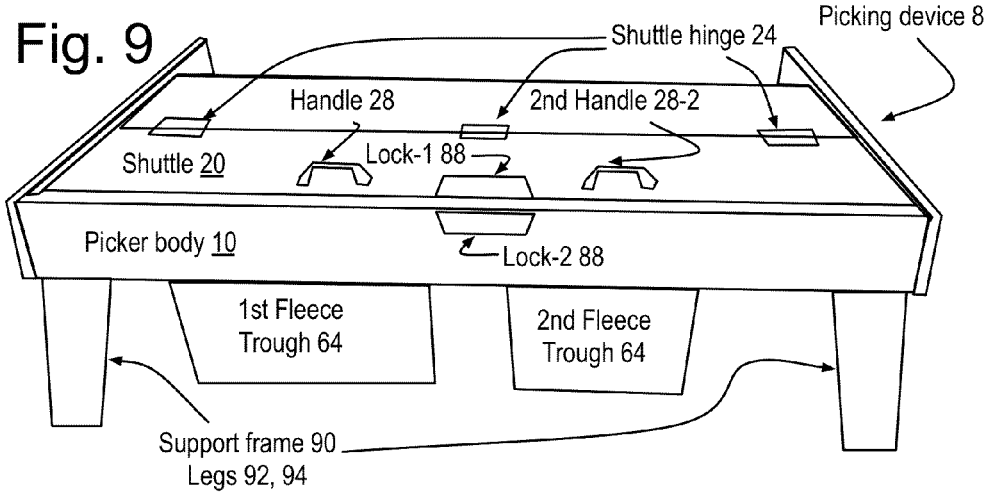
FIG. 9 shows the first example of the picking device 8 in position to engage the first and second part of a lock to lock the picking surfaces out of the way of children.
Figure 10:
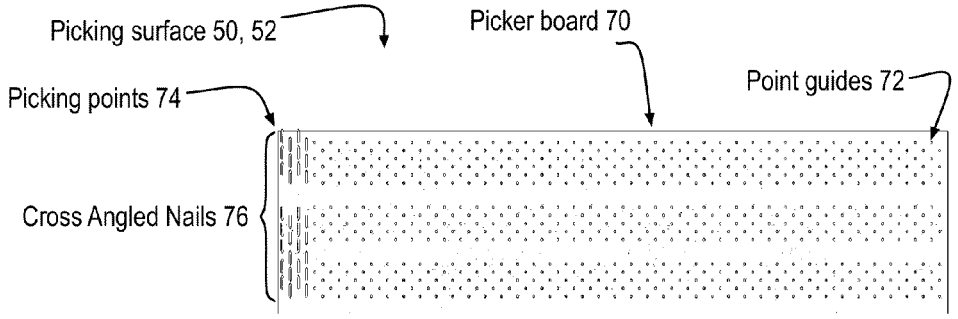
FIG. 10 shows some details of one or both of the picking surfaces 50 and 52, comprising a picker board 70 including point guides 72 adapted to create picking points 74 that collectively form the cross-angled nails 76 to contribute to the picking surface or picking surfaces.

- The upward picking surface 50 includes a first set of cross-angled rows of nails, referred to hereafter as first set of cross angled nails 76 as shown in FIG. 10 and FIG. 11.
- The downward face 90 is smooth and adapted so that the heads of the nails of the upward picking surface 50 cannot scratch something the downward face 90 is placed upon, such as a coffee table as shown in FIG. 5 and FIG. 6.
- The picked fleece shoot 60 connects the upward picking surface 50 and the downward face 90 and is adapted to draw the picked fleece removed from the upward picking surface 50 and past the downward face 90 to create a removed and picked fleece. The removed and picked fleece may be collected in aa fleece trough 64, which may be embodied as a bag, basket, bin, bowl and/or tub for later use as shown in FIG. 1 and FIG. 9.

The shuttle 20 includes a downward picking surface 52, also referred to as the second picking surface 52. The shuttle may include an upward face and/or at least one runner 56 adapted to travel in the track or tracks 16 to engage with the upward picking surface 50 to pick apart the fiber 102 of FIG. 14 to create the picked apart fiber 90 shown in FIG. 8.

- The downward picking surface 52 includes a second set of cross-angled rows of nails.
  - The first set of cross angled nails 76 and the second set of cross-angled nails 76 are adapted so that the nails of the second set pass between the nails of the first set as the engaged downward picking surface 52 moves back and forth through the nails of the upward picking surface 50 as shown in FIG. 5 and FIG. 6.
- The upward face 25 is adapted to protect the hands of the user and the hands of others such as their children and/or guests from having contact with the nails of either of the picking surfaces 50 and/or 52.
- The runner 56 may be implemented on at least one of the sides of the shuttle 20 as shown in FIG. 1 or near the middle of the shuttle 20, which has not been shown.
- In some implementations, the runners 56 may be implemented as the sides of the shuttle 20, which may be parallel the back and forth motion of shuttle 20.
- In some further implementations the runners 56 may be adapted to the tracks of the picker body 10, which may be implemented using drawer slides.

The shuttle 20 may further include at least part of a latch 88 as shown in FIG. 9. The latch 88 may be adapted to couple to the picker body 10 to lock the shuttle 20 over the upward picking surface 50 to keep the rows of cross-angled nails 76 away from children and other creatures prone to accidents.

The shuttle 20 may further include a panel coupled by a hinge 24 to a second panel 26 as shown in FIG. 2, FIG. 3, FIG. 4, and FIG. 9.

- The panel may make up part of the upward face and all the rows of cross-angled nails of the downward picking surface 52.
- When the picking surfaces are full of picked fleece, the panel may be lifted to reveal both picking surfaces, which may then be combed using the picker comb 70 to remove the picked fleece from between the nails.
- The panel 20 or the second panel 26 may include at least part of the latch 88 adapted to couple to the picker body 10 to lock the shuttle 20 over the upward picking surface 50 to keep the rows of cross-angled nails as shown in FIG. 9.

FIG. 3 and FIG. 4 show a second example of the picking device 8. The picker bed is shown with a single picked fleece shoot 60. The shuttle 20 is shown including one or more handles 28 cut from the upward face 25. The shuttle hinge 24 may be implemented as a piano hinge in some situations. FIG. 3 also shows a pin hole that may be used to lock 88 the shuttle 20 over the upward picking surface 50 to protect people, particularly children, when the picking device is not in operation. The smooth upward face 25 also protect the user's hand from the sharp picking points of the upward picking surface 50 both during operation and when the picking device is locked 88.

FIG. 4 shows the handle(s) 28 being used in a tilted position to support a tall person operating the picking device 8 without need to adjust the height of the picking device.

FIG. 5 and FIG. 6 shows some details of either example of the picking device 8. The first picking surface 50 and the second picking surface 52 are show close to each other. In operation they actually engage each other. The picking points 54 of the first picking surface 50 are adapted so that the picking points of the second picking surface 52 pass between the nails of the first set as the engaged downward picking surface 52 moves back and forth through the nails of the upward picking surface 50.

FIG. 5 shows some embodiments of the picking device 8, where the downward face 60 is adapted so that the head of the nails are recessed, removing the chance that they will mar the furniture surface 200 upon which the picking device 8 is placed. Note that in some further embodiments, the downward face 60 may further include a coat or layer of a sealer, such as epoxy to further protect the furniture surface 200.

FIG. 6 shows some embodiments of the picking device 8, where the first picking surface 50 is coupled and/or bonder to the picker body 10 to create the downward surface 60.

FIG. 7 shows some examples of picker combs 70. The picker comb 70 may include a comb handle 72 coupled to a row of teeth 74. The row of teeth 74 may be coplanar as in the first and third picker combs 70. In other embodiments, for instance in the second picker comb 70, the row of teeth may not be coplanar.

The teeth 74 may be nails themselves. In other embodiments, the teeth may be implemented using knitting needles or other relatively inflexible tines, which may be made from metal, bone, wood and/or plastic.

All of these embodiments of the picker combs are adapted to pass between the nails of the first picking surface 50 and/or the second picking surface 52.

The picker comb 70 may be used by engaging it with the first or second set picking surfaces 50 and/or 52 and when moved through the cross-angled nails, accumulate the picked apart fleece, removing it from the nails.

The picker comb 70 may further include a holder coupled to the row of nails. The holder may be essentially parallel the row of teeth, or possibly at an angle to the row of teeth.

Figure 8:
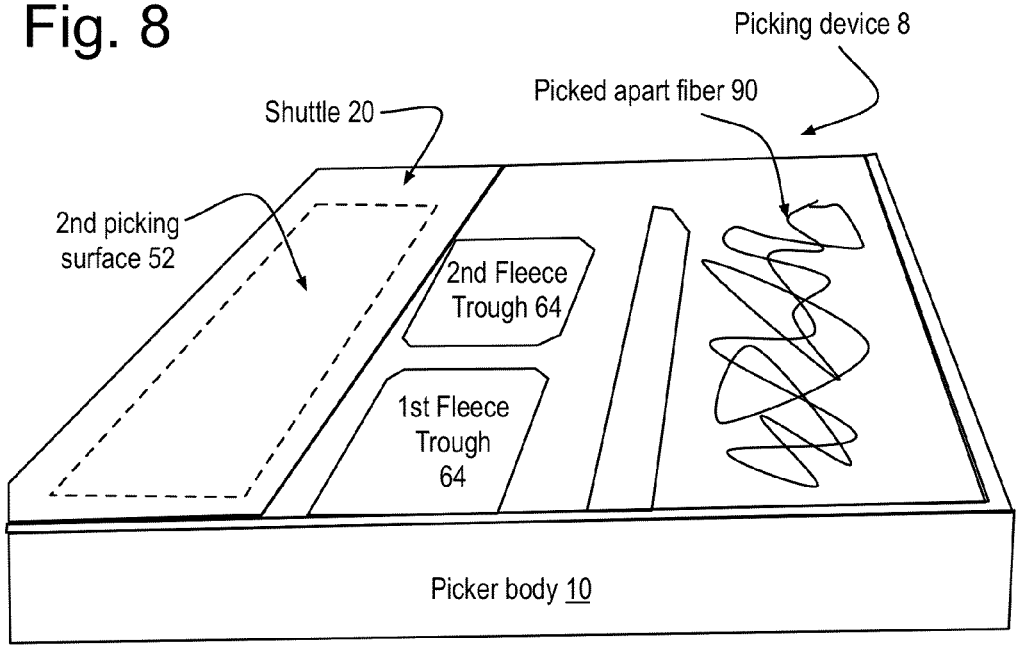
FIG. 8 shows the picked apart fiber 90 being removed from the cross-angled nails through the use of one or more of the picker combs 70.

FIG. 8 shows the picked apart fiber 90 being removed from the cross-angled nails through the use of one or more of the picker combs 70.

FIG. 9 shows the first example of the picking device 8 in position to engage the first and second part of a lock 88 to lock the picking surfaces 50 and 52 out of the way of children and/or other people.

FIG. 10 shows some details of one or both of the picking surfaces 50 and 52, comprising a picker board 70 including point guides 72 adapted to create picking points 74 that collectively form cross-angled nails 76 to contribute to the picking surface 50 and/or 52.

Figure 11A:
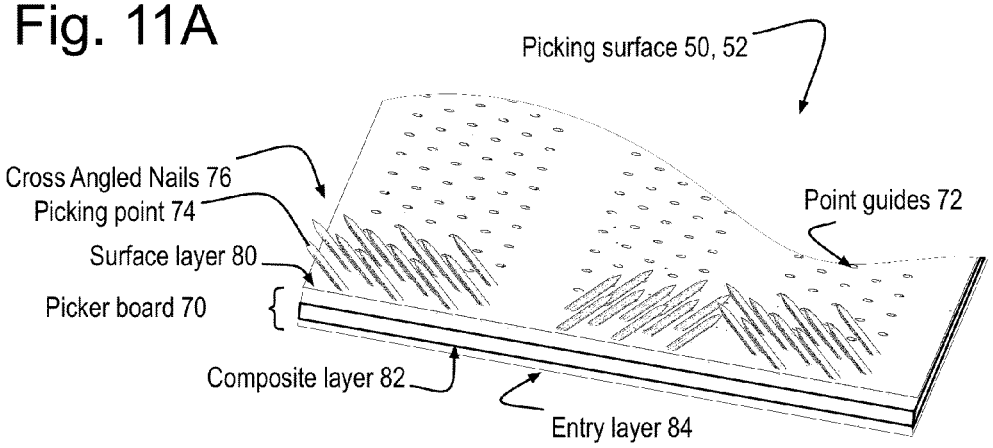

FIG. 11A shows some details of the picking surface 50 and/or the picking surface 52, in particular, the picking board 70 as shown in FIG. 10, the cross angled nails 76 coupled through the point guides 72 to create the picking points 74.

FIG. 11B shows some details of the picking board 70 including at least one of a solid wood 90, a plastic 92, a metal 94 and/or a composite 96. The composite 96 may include a surface layer 80 a composite layer 82 and an entry layer 84.

The solid wood 90 may include a hard wood and/or a rigid wood. The hard wood may include at least one of oak, eucalyptus and/or maple. The rigid wood may include at least one of poplar, pawlonia and/or balsa. The solid wood 90 may be considered to have the surface layer 80 and the entry layer 84, made of the same wood.

The plastic 92 may include polusulfone and/or epoxy.

The metal 94 may include alumninum, copper, iron and/or steel.

The composite 96 may include MDX and/or a form or plywood and/or a sandwich of a wooden entry layer 84 and a wooden surface layer 80, with a composite layer of either a rigid wood and/or a plastic, the exact composition of which may be derived by one of ordinary skill in the art.

FIG. 12 shows the picker board 70 by itself as seen from the surface layer 80 shown in FIG. 11A and FIG. 11B. The point guides 72 are shown as the nail guide 60 shown in further detail in FIG. 13.

FIG. 13 shows some details of the picking point 74 as a nail 130 residing below the entry layer 84 in with the head of the nail lodged a countersink guide 62 and the shank of the nail passing through a nail guide 60.

FIG. 14 shows an animal 100 producing fiber 102, which typically includes fleece 104 and/or wool 106. The animal may be genetically derived from at least one, and sometimes more than one of the following: a sheep 110, a goat 112, a llama 114, an alpaca 116, a rabbit 118, a dog 120, a buffalo 122, a yak 124 and/or a vicuna 126.

Figure 15:
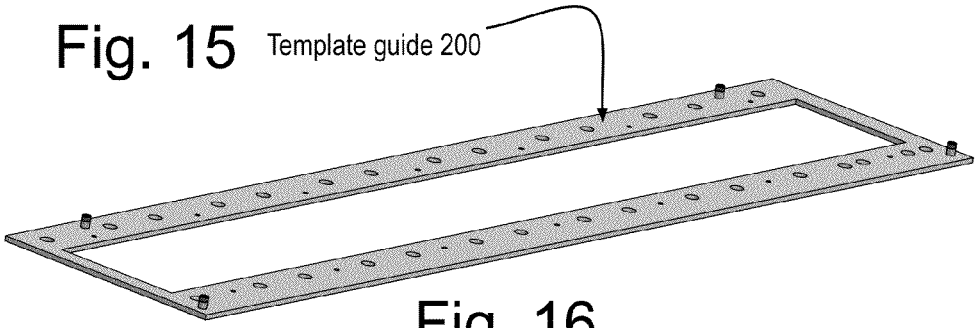
FIG. 15 shows a template guide 200 that may be adapted to temporarily couple on a board to align a nail template 210 and/or a nail head template 220 to create the picking board 70.

FIG. 15 shows a template guide 200 that may be adapted to temporarily couple on a board to align a nail template 210 and/or a nail head template 220 to create the picking board 70.

Figure 16:
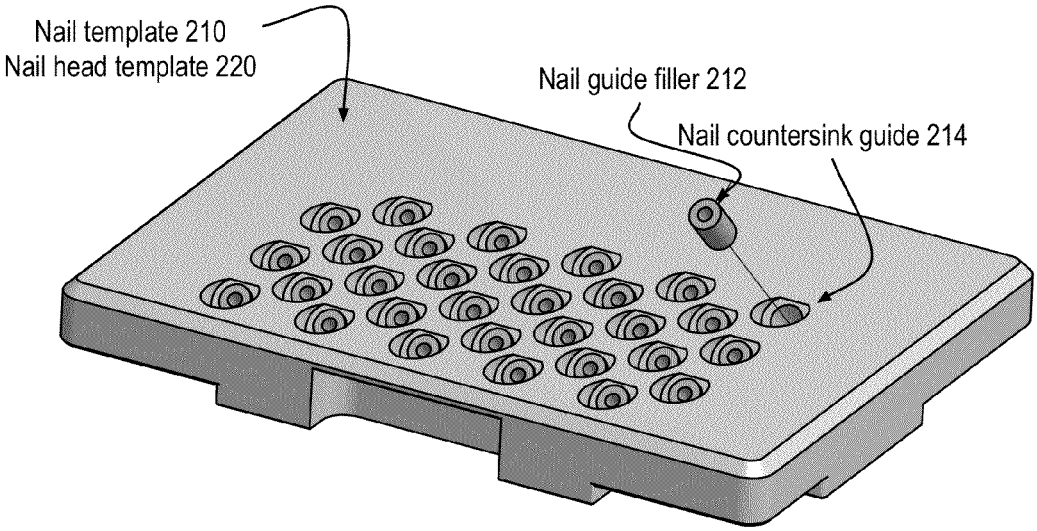
FIG. 16 and FIG. 17 show some details of the nail template 210 and/or the nail head template 220, each adapted to temporarily mount on the template guide 200 of FIG. 15 while it is coupled to the board to create the picker board 70.
Figure 17:
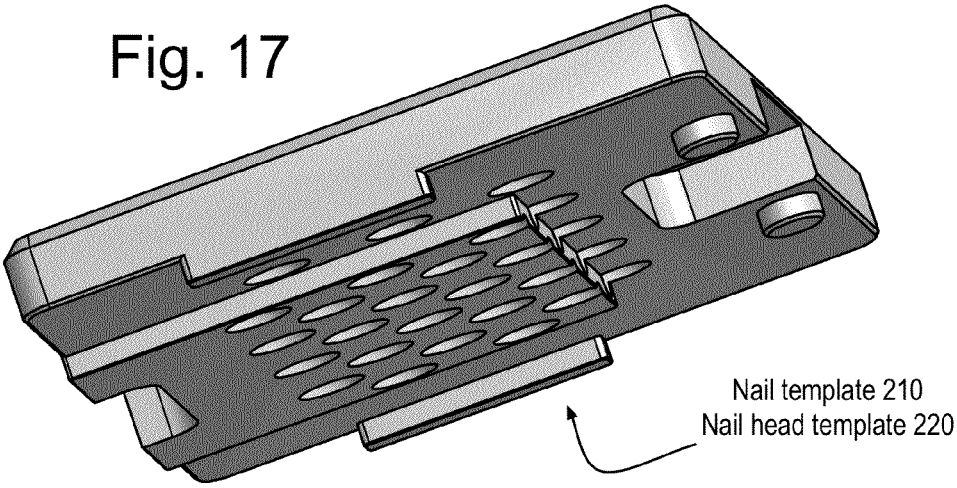

FIG. 16 and FIG. 17 show some details of the nail template 210 and/or the nail head template 220, each adapted to temporarily mount on the template guide 200 of FIG. 15 while it is coupled to the board to create the picker board 70.

The invention also includes innovative processes of operation and manufacture.

The apparatus may be operated by some or all of the following steps:

Part or all of the fleece may be positioned for engagement near the the upward picking surface 50.

Moving the shuttle 20 back and forth engages the fleece between the downward picking surface 52 and upward picking surface 50 to create the picked fleeces between the nails of the first set or second set of cross-angled nails.

Opening a panel of the shuttle 20 to reveal the rows of cross-angled nails for combing.

Combing using the picker comb 70 by moving the comb teeth between the nails of the first set or the second set of the cross-angled nails accumulates the picked apart fleece away from the nails.

Removing the picked apart fleece from the picker comb 70 may include dropping the picked apart fleece into the fleece shoot.

Locking 88 the shuttle 20 over the picker body 10 reduces the chance of injury from contact with the cross-angled nails.

Operating the apparatus may further include one or more of the following steps:

Positioning the picker assembly 14 on top of a piece of furniture without scratching it.

Attaching a set of legs to the picker assembly 14 to create a standalone picker assembly 14.

Retracting the legs to store and/or transport the standalone picker assembly 14.

Extending retracted legs of the standalone picker assembly 14 after storage and/or transport.

Manufacturing the apparatus may include one or more of the following steps:

Fabricating the picker body 10 to couple with the picking bed 12 and the moveable shuttle 20, Fabricating the picking bed 12 to create the upward picking surface 50 and/or the picked fleece shoot 60, Coupling the picker body 10 to the picking bed 12 to create the picker assembly 14, Combining the shuttle 20 with the picker body 10 to at least partly create the picking device 8, Combining the shuttle 20 with the picker assembly 14 to create the picking device 8, and/or Forming the row of teeth to at least partly create the picker comb 70.

The picker body 10, the picking bed 12, the picker assembly 14, the shuttle 20, the picking device 8 and/or the picker comb 70 are all products of the manufacturing process.

The picker body 10 may include an open ended box with a groove on the inside toward the bottom, with the groove adapted for insertion of the picking bed 12. Once inserted, a face may cover the open end of the box to fix the coupling with the inserted picking bed 12 to create the picker assembly 14.

The box may form a rectangle or an oval or another convex shape that can accommodate the back and forth motion of the shuttle 20 over the picking bed 12.

A rectangular version of the box may be constructed using braces or wood working joints, such as dovetails or mortise and tenon joints.

The groove of the picker body 10 may coupled to the picking bed 12 to form a tongue and groove joint on three or four sides of the picker assembly 14's box.

The oval form of box may be fabricated through gluing thin rows of wood or plastic about a form.

The first and second sets of cross-angled nails may be formed as follows:

There may be a consistent distance between the nails, such as ½ inch, ¾ inch and so on.

Neighboring rows of nails may be set at a first angle and a second angle so that the nails of the rows cross each other.

The first angle may be perpendicular to the second angle.

The first angle may be between 30 and 60 degrees.

The first angle may further be about 45 degrees.

A row of nails may be manufactured in any of several ways, for example:

A row of nails may be fabricated by drilling holes at the first angle or the second angle, then inserting nails into the holes.

A template may be used. The template may be made from hard wood, plastic, or metal, such as iron or steel.

A row of nails may be fabricated by creating nail tracks using a table saw in a large piece of wood, say a 1 by 12.

The large piece may be rip cut to strips ¾ to 1¼ inch wide. The rip cuts may be beveled at a first angle, such as 45 degrees. And the strip length may be any length, but possibly preferred to be 18, 24, 36 and/or 48 inches.

Two strips may be aligned so that their nail tracks match and nails with glue on their heads and the 1$^{st}$ ½ inch may be pushed down the tracks.

The glue may be any wood or plastic bonding glue, for example, Elmer's Weldwood, or Epoxy.

The nail heads may then be placed in a trough filled with enough glue to seal in the nail heads and form a smooth face when the glue has set to form the a row of nails aligned at the first angle.

A picking surface 50 and/or 52 may then be made from several of the rows of nails by placing the rows each in a slot with glue to form a row at the first angle or at the second angle, thereby making the rows of cross-angled nails.

The preceding discussion serves to provide examples of the embodiments and is not meant to constrain the scope of the following claims.

The invention claimed is:

1. An apparatus, comprising:

a picking device adapted for a user to operate to pick apart a fiber to create a picked apart fiber ready for carding; wherein said fiber includes at least one of a wool and a fleece of at least one animal;

said picking device including a picker body, a first picking surface attached to said picker body, a shuttle arranged to run in a track of said picker body and a second picking surface forming at least part of a first side of said shuttle, where said first picking surface and said second picking surface include nails to pick apart said fiber;

and said picking device further adapted to perform at least one protect said user from bodily injury during operation of said picking device by said shuttle presenting a panel to said user that protects said user, protect possibly other people from injury when said picking device is not in operation by said panel covering said first picking surface and said second picking surface, protect a furniture surface upon which said picking device is laid upon by said picking device including a downward face to protect said furniture surface from said first picking surface and said second picking surface, and remove said picked apart fiber while protecting said user's hands and/or fingers by said picking device including at least one of a fleece shoot and a fleece trough situated away from said nails.

2. The apparatus of claim 1, wherein said animal is genetically derived from at least one of a sheep, a goat, a llama, an alpaca, a rabbit, a dog, a buffalo, a yak and/or a vicuna.

3. The apparatus of claim 1, wherein said picking device Comprises a picking bed adapted to couple to said picking body and support back-and-forth movement of said shuttle over said picking body to process said fibers between said shuttle and said picking bed to create a picked apart fiber.

4. The apparatus of claim 3, wherein said picking device is adapted to protect said user from bodily injury during operation of said picking device further comprises said shuttle including at least one handle adapted for said user to hold with hands away from said picking surfaces.

5. The apparatus of claim 3, wherein said picking device is adapted to protect possibly other people from injury when said picking device is not in operation further comprises said shuttle locked to said picked body with said picking surfaces covered to prevent said injury.

6. The apparatus of claim 3, wherein said picking device is adapted to protect a furniture surface upon which said picking device is laid upon further comprises a downward surface adapted to protect said furniture surface when said picking device is lad upon said furniture surface.

7. The apparatus of claim 3, wherein said picking device is adapted to remove said picked apart fiber while protecting at least one of said user's hands and fingers further comprises a picker comb adapted to remove said picked apart fiber from said picking surfaces while protecting at least one of said user's hands and said fingers.

* * * * *